US008847842B2

(12) United States Patent
Zeiger et al.

(10) Patent No.: US 8,847,842 B2
(45) Date of Patent: Sep. 30, 2014

(54) GPS ANTENNA ON-SHIELD/HOUSING WITH GROUNDING

(75) Inventors: David Zeiger, Mundelein, IL (US); Young Son, Glenview, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 350 days.

(21) Appl. No.: 13/295,374

(22) Filed: Nov. 14, 2011

(65) Prior Publication Data

US 2013/0120210 A1 May 16, 2013

(51) Int. Cl.

| | |
|---|---|
| ***H01Q 1/52*** | (2006.01) |
| ***H01Q 9/04*** | (2006.01) |
| ***H01Q 1/32*** | (2006.01) |
| ***H01Q 1/48*** | (2006.01) |

(52) U.S. Cl.

CPC ..... *H01Q 9/045* (2013.01); *H01Q 1/526* (2013.01); *H01Q 1/3275* (2013.01); *H01Q 1/48* (2013.01)

USPC ..... 343/841; 343/713; 343/700 MS

(58) Field of Classification Search

USPC ..... 343/700 MS, 841, 711, 712, 713

See application file for complete search history.

(56) References Cited

U.S. PATENT DOCUMENTS

| | | | | |
|---|---|---|---|---|
| 5,333,095 | A | 7/1994 | Stevenson et al. | |
| 6,522,291 | B1 | 2/2003 | Noguchi et al. | |
| 2010/0277379 | A1* | 11/2010 | Lindackers et al. | 343/713 |

FOREIGN PATENT DOCUMENTS

| | | | |
|---|---|---|---|
| DE | 102009051605 | A1 | 5/2011 |
| JP | 2000216630 | A * | 8/2000 |
| JP | 2001332919 | A | 11/2001 |

OTHER PUBLICATIONS

International Search Report and Written Opinion dated Dec. 6, 2012, from corresponding International Patent Application No. PCT/US2012/058457.

* cited by examiner

*Primary Examiner* — Dieu H Duong

(57) ABSTRACT

An electrically-conductive housing is configured to support a patch antenna and to enclose or cover electronic components mounted onto a circuit board to which the housing is attached. The housing is formed to have a grounded passageway for a feed line for the patch antenna. The passageway thus acts as a RF shield. An optional ferrule can be placed into the shield to align the feed line. An optional feed line contact can be placed into the ferrule to allow for the housing construct to behave as an RF connector.

20 Claims, 4 Drawing Sheets

GPS ANTENNA ON-SHIELD/HOUSING WITH GROUNDING

BACKGROUND

Many vehicles are now being provided with a global position system or GPS navigation. The performance a vehicle GPS system is dependent on many factors but the antenna that receives GPS signals is particularly important. Unfortunately, electronic devices continue to trend downwardly in size. The need to configure a GPS navigation system for use in a vehicle, coupled with the need to reduce the size of electronic devices generally, means that providing a good antenna for a GPS receiver can be problematic.

Many GPS systems use patch antennas. A patch antenna is essentially a square or rectangular patch of conductive material applied to a dielectric block. A ground plane for the patch is essential. A ground plane is provided by a second conductive patch applied to an opposite side of the same dielectric block. This ground plane is typically coupled to a larger ground plane in the GPS system to increase performance of the antenna.

In order to improve GPS system performance without limiting circuit board placement, some GPS navigation system manufacturers have moved the antenna for the GPS receiver to a second circuit board that is located away from the GPS receiver. While moving the antenna to a second circuit board allows for increasing the size of a patch antenna as well as increasing the size of the required ground plane, moving the antenna away from the receiver electronics causes additional signal loss. It also adds component expense and assembly complexity.

DETAILED DESCRIPTION

Figure 1:
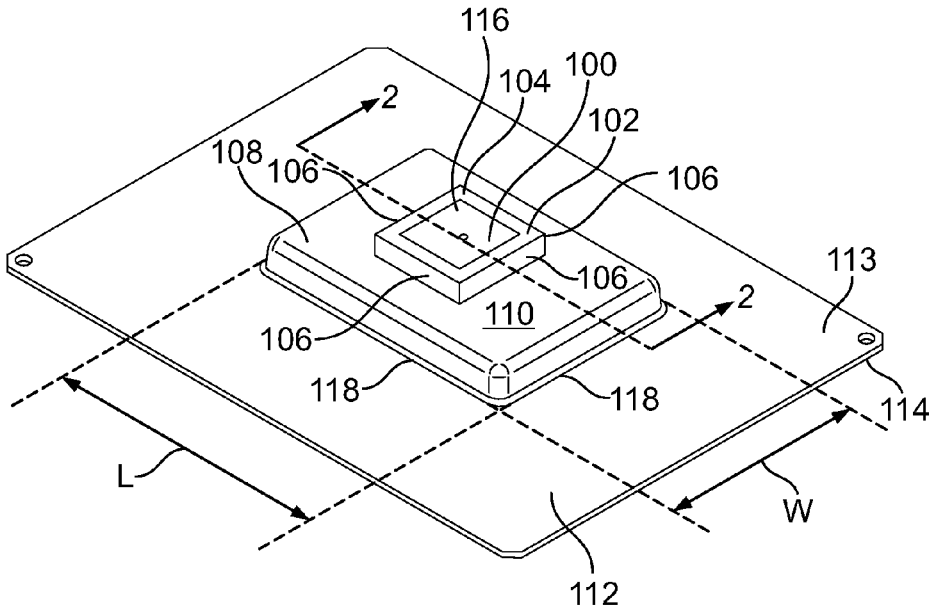
FIG. 1 is a perspective view of a patch antenna attached to a dielectric substrate.

FIG. 1 is a perspective view of a patch antenna 100 attached to a dielectric substrate 102. The antenna 100 is essentially a thin, square or rectangular patch of metal having a top surface facing upwardly, and an opposing bottom surface, not visible in FIG. 1 because it is applied against the top surface 104 of the substrate 102. An antenna ground plane, not visible in FIG. 1 or FIG. 2 and best seen in FIG. 3, is applied to the bottom surface of the dielectric substrate 102. The bottom surface of the dielectric substrate 102 is not visible in FIG. 1.

The shape of the substrate 102 is reminiscent of a rectangular parallelepiped, which is parallelepiped, the faces of which are all rectangles. The substrate 102 has a substantially square top face or surface 104 to which the bottom surface of the patch antenna 100 is attached. The top face 104 of the substrate 102 is bounded by four, substantially rectangular-shaped sides 106. The substrate 102 has a bottom face or surface, also bounded by the four sides 106, but is not visible in FIG. 1, because it is attached to the top surface 108 of a metal component housing 110. The housing 110 is described more fully below. Each side 106 of the substrate 102 has a height that corresponds to the thickness of the substrate 102.

The patch antenna 100 is a thin, square metallic pad. It has a top surface 116 facing upward. The patch antenna 100 also has a bottom face or surface, not shown. An elongated feed line, not visible in FIG. 1, is attached to the bottom face of the antenna 100 and extends downwardly through the substrate 102 but also through the electrically conductive component housing 110. The substrate 102, and the patch antenna 100 that the substrate 102 supports, are carried by or mounted on the component housing 110.

The electrically conductive component housing 100, which for brevity is also referred to herein simply as a housing 110, is mounted on a conventional circuit board 112. The housing is attached typically by soldering one or more edges 118 of the metal walls of the housing 110 to one or more corresponding electrical conductors on the top surface 113 of the circuit board 112. Electrical conductors to which the edges 118 of the walls of the housing 110 are attached, are preferably connected to a ground or reference potential for electrical components on the circuit board 112 in order to "ground" the housing 110.

The housing 110 is sized, shaped and arranged or "configured" to be mechanically attached to the circuit board 112 but to also extend over one or more components attached to the circuit board and which lie underneath or within the housing 110. Such components are not visible in FIG. 1 but can be seen in FIG. 2.

Figure 2:
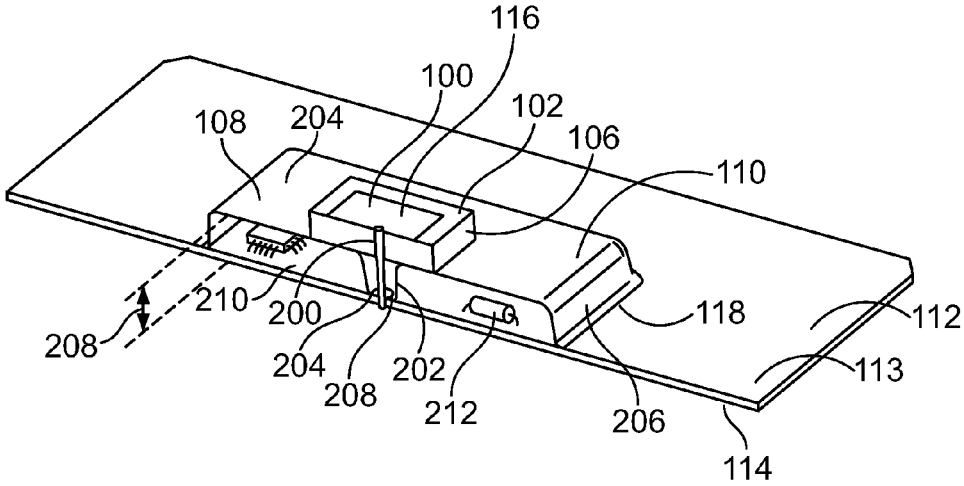
FIG. 2 is a perspective view of the structure shown on FIG. 1 taken through section lines 2-2.
Figure 3:
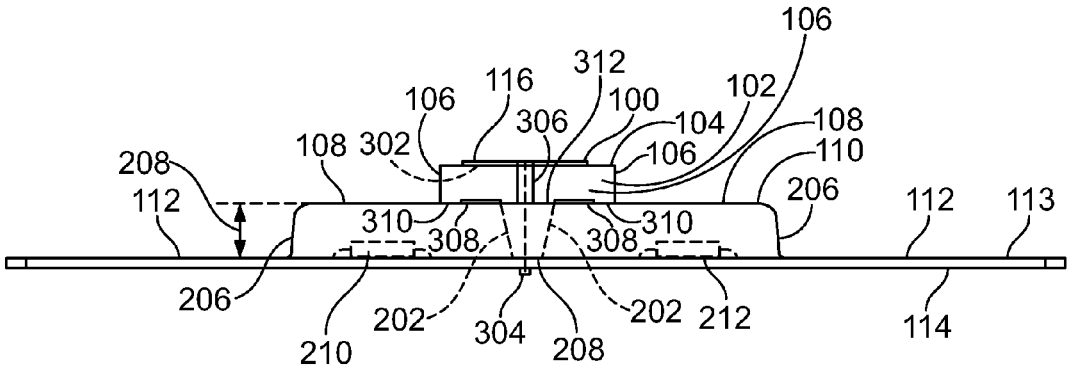
FIG. 3 is a cross-sectional view of the structure shown in FIG. 1 and FIG. 2.

FIG. 2 is a perspective view of the structure shown on FIG. 1 taken through section lines 2-2. The elongated antenna feed line 200 can be seen as extending downwardly from the bottom or lower face of the patch antenna 100 through the bottom 114 of the circuit board 112. The feed line 200 extends through a generally tube-shaped shield portion 202 of the housing 110. The shield portion 202 is formed from the same conductive material as the housing 110. Grounding the housing 110 thus enables the shield portion 202 to provide an electromagnetic radiation shield for radio frequency energy passing along the feed line 200.

The shield portion 202 is preferably formed as part of the housing 110 by molding the housing 110 and the shield portion 202 together, however, a preferred method of forming the housing and shield portion 202 is to stamp a thin sheet of metal to have the shape of the housing and its included shield portion 202.

The housing 110 has a substantially square-shaped planar top panel or surface 204. The top panel 204 is supported by four substantially vertical side walls 206. As mentioned above, the side walls 206 have lower or bottom edges identified by reference numeral 118. The edges 118 of the side walls 206 are attached to one or more electrically-conductive traces on the top surface 113 of the circuit board 112. Since the housing 110 is conductive, grounding the side walls 206 also grounds the top panel 204 as well as the shield portion 202. The top panel 204 thus provides a ground plane for the patch antenna 100 while the shield portion 202 provides an RF shield.

Those of ordinary skill in the art know and will recognize that the performance of an antenna can be improved by increasing the size of an antenna ground plane. Increasing the size of the top panel 204 thus improves the performance of the patch antenna 100.

Locating a ground plane for a patch antenna, directly onto a circuit board surface, wastes circuit board area. Raising the antenna ground plane above the surface of a circuit board, however, so that it is above components mounted on the circuit board can provide a good ground plane without sacrificing usable circuit board area.

The top panel 204 of the housing 110 is elevated above the top surface 113 of the circuit board 112 by the housing side walls 206 by a distance to allow the housing 110 to extend over or cover components that are mounted to the circuit board but underneath the housing 110. Each side wall 206 of the housing 110 has the same vertical height 208 so that the top panel 204 is kept substantially parallel to the surface of the circuit board 112 and to avoid tilting the patch antenna 100. Tilting the antenna 100 would tend to make the antenna directional.

Since the tube-shaped shield portion 202 is integrally formed with the rest of the housing 110, the tube-shaped shield portion 202 provides an electromagnetic radiation shield for the antenna feed line 200. In a preferred embodiment, the shield portion 200 has a height substantially equal to the height of the walls 208 to allow the shield portion 202 to make an electrical contact 204 with grounded conductive material on the top surface 113 of the circuit board 112.

The feed line 200 passes through a small hole 208 formed in the bottom of the tube-shaped shield portion 202. The hole 208 allows the feed line 200 to remain electrically isolated from the electrically conductive component housing 110 yet make contact with a signal lead on one or both surfaces of the circuit board 112.

FIG. 3 is a cross-sectional view of the patch antenna 100, the top surface of which is identified by reference numeral 116. The substrate 102 that supports the antenna 100, the housing 110 and the circuit board 112 are also shown in cross section. The patch antenna 100 is depicted FIG. 3 as a somewhat thicker line in order to better distinguish the antenna 100 from the top surface 104 of the dielectric block 102. Reference numeral 116 identifies the top surface of the antenna 100. A ground plane 308 on the bottom surface 310 of the dielectric block 102, embodied as a thin layer of metal, is depicted as a relatively thick line between the bottom surface 310 of the block 102 and the top surface 108 of the housing 110 in order to distinguish the ground plane 308 from the bottom surface 310 of the block 102 and to distinguish the ground plane 308 from the top surface 108 of the housing 108. The ground plane 308, which is a thin layer of metal on the bottom surface 310, is formed with a centrally-located hole 312 through which the feed line 200 can pass. The ground plane 308 makes a direct electrical connection with the top surface 108 of the housing 110.

The top surface 116 of the antenna 100 is has an opposing lower surface 302. The lower surface 302 of the antenna 100 is attached to the top face 104 of the dielectric block 102 by an adhesive, not visible in the figures.

The feed line 200 extends through a tunnel or passageway 306 that extends through the dielectric block 102 and into the tube-shaped shield portion 202. The feed line also extends through the top surface 113 of the circuit board 112 to a conductive circuit trace 304 on the bottom surface 114 of the circuit board 112. Radio frequency signals on the circuit trace 304 are conveyed into and out of the patch antenna via the elongated feed line 200, but which is electrically shielded by the shield portion 202 of the housing 110.

Figure 4:
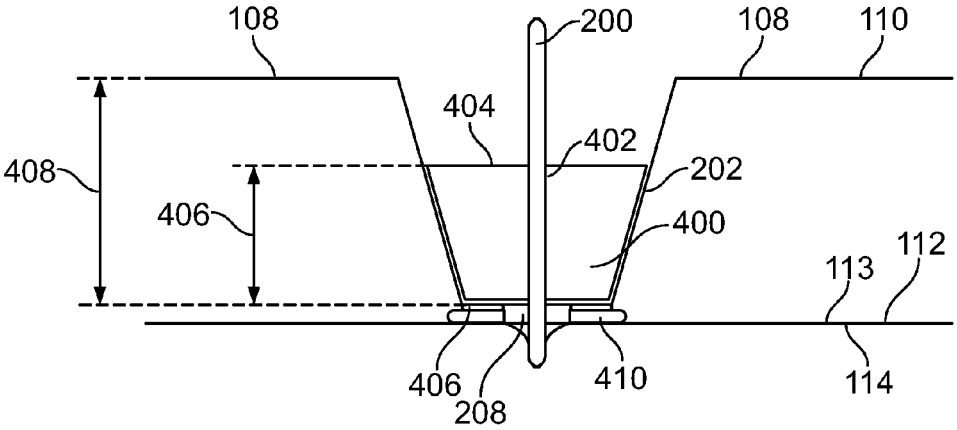
FIG. 4 is an isolated cross-sectional view of the shield portion of the conductive housing shown in FIGS. 1-3.

FIG. 4 is an isolated cross-sectional view of the shield portion 202 of the conductive housing 110. Stamping a perfectly vertical shield portion 202 can create localized stress concentrations. The shield portion 202 is therefore depicted as having a generally trapezoidal shape because the housing 110 and its shield portion 202 are formed most efficiently and most economically by stamping metal sheet.

An optional dielectric ferrule 400 is placed into the shield portion 202 and located at or near the bottom of the shield portion 202. The ferrule 400, which is formed from a flexible dielectric material, is configured to keep the feed line 200 centered or aligned in the shield portion 202 and keep the feed line 200 centered in the hole 208 located at the bottom of the shield portion 202. The ferrule 400 therefore has a small diameter hole 402 that extends through the ferrule 400. A layer of solder 410 between the bottom 406 of the shield portion 202 and a grounded conductive trace (not visible) on the top 113 of the circuit board 112 provides an additional ground path for the housing 110.

Figure 5:
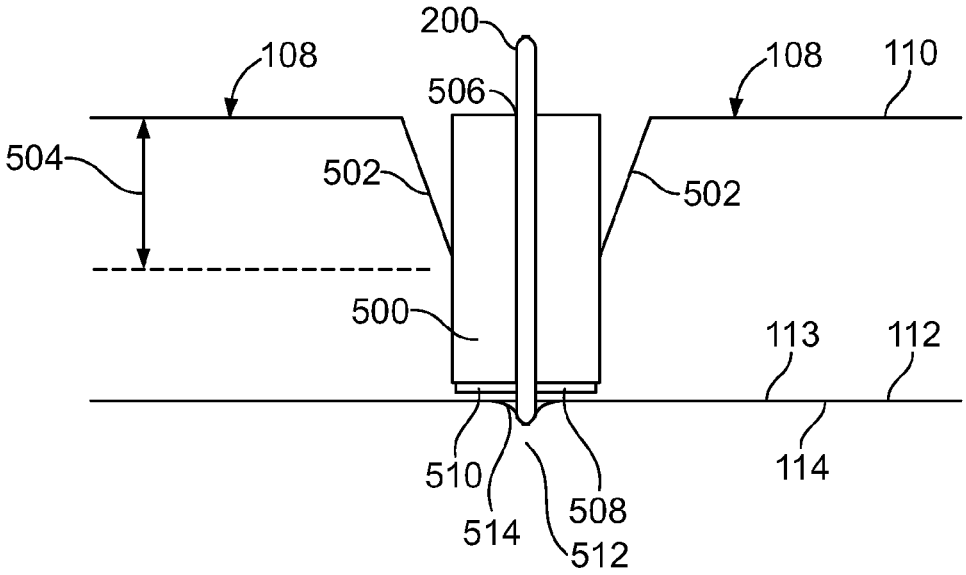
FIG. 5 is a cross-sectional view of another embodiment of the shield portion and an embodiment of a ferrule for a feed line.

FIG. 5 is a cross-sectional view of another embodiment of the shield portion 502 and another embodiment of a ferrule 500. In FIG. 5, the shield portion 502 does not extend all the way from the top panel 108 of the housing 110 to the top surface 113 of the circuit board 112. The shield portion 502 instead extends downwardly from the top 108 of the housing 110 by a relatively short distance 504 relative to the top 108 of the housing 110. Stated another way, the shield portion 502 does not extend all the way down to the top surface 113 or the circuit board 112. In FIG. 5, the shield portion 502 has a height less than the height 208 of the wall 206 of the housing 110.

The ferrule 500 is formed from an elastic and dielectric material. It has an extended length and a through-hole 506. The interior surface of the through-hole 506 is lined with electrically conductive material 508. The inside diameter of the through-hole 506 is selected to be less than the outside diameter of the feed line 200. The feed line 200 is thus forced through the ferrule 500 to electrically connect the conductive material 508 lining the feed hole 506.

A bottom face 508 of the cylindrically-shaped ferrule 500 is coated with the same conductive material 506. It electrically contacts an RF signal path on the top surface 113 of the circuit board 112, but which is not visible in the figure. The distal extreme bottom or distal end 512 of the feed line 200 is soldered to another conductive trace on the bottom side 114 of the circuit board 112. Conductive material 506 on the inside of the through hole 506 and on the bottom face 508 of the ferrule 500 thus electrically connects the feed line 502 with a signal conductor on the circuit board but which is not shown in FIG. 5, on the top surface 113 of the circuit board 112.

In one embodiment, the tube-shaped shield portions 202 and 502 have a shape reminiscent of either a cylinder or a cone due to the fact that the housing 110 is stamped and the shield portions 202 and 502 are formed by a cylindrically-shaped mandrel. In alternative embodiments, the shield portions 202 and 502 can have other cross-sectional shapes that include square or rectangular.

Figure 6:
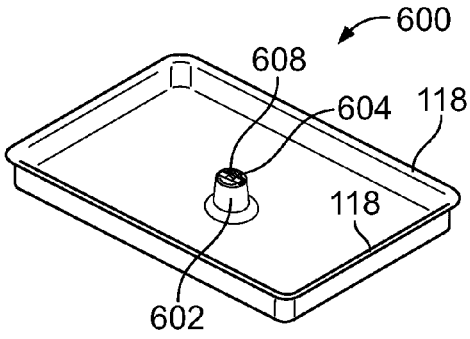
FIG. 6 is a perspective view of the underside of a conductive housing having an alternate embodiment shield portion and an alternate embodiment ferrule.

FIG. 6 is a perspective view of the underside of another embodiment of a conductive housing 600 formed to have an alternate embodiment shield portion 602 and an alternate embodiment ferrule 604 inside the shield portion 602. The housing 600 is shown inverted to show that the shield portion 602 is not formed with a circular hole for the feed line but is instead provided with a substantially rectangular slot 608, which receives a push-type connector for an antenna feed line.

Figure 7:
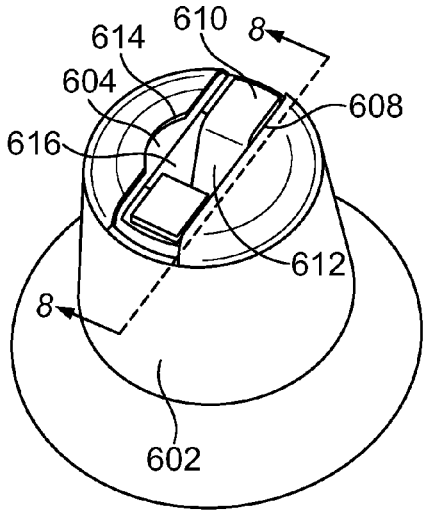
FIG. 7 is an isolated view of the alternate embodiment shield portion and an alternate embodiment ferrule shown in FIG. 6.

FIG. 7 is an isolated view of the shield portion 602 depicted in FIG. 6. The substantially rectangular slot 608 accepts or receives two substantially planar bottom wings 610 of a feed line connection clip 612 that is fit inside a somewhat parallelepiped-shaped void or space 616 inside the ferrule 614. Like the ferrules described above, the ferrule 614 in FIG. 6011 is also formed from a dielectric and compressible material.

Figure 8:
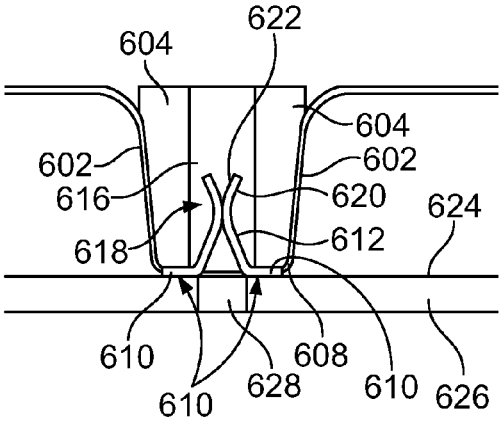
FIG. 8 is a cross section of the structure shown in FIG. 7 taken through section lines 8-8.

FIG. 8 is a cross section of the structure shown in FIG. 7 taken through section lines 8-8. The connection clip 612 can be seen as having a cross-sectional shape reminiscent of a teepee, which is a conical tent, that usually consisted of skins and which was used by American Indians of the Great Plains. Two generally "C-shaped" metal strips form left and right sides of the clip 612. A left side 618 of the clip and a right side 620 of the clip are formed to bend or extend away from each other in opposite directions and to define an open feed line-receiver portion 622.

The wings 610 of the connection clip 612 rest on the top surface 624 of a convention circuit board 626. The wings 610 and the feed line-receiver portion 622 are centered over a hole 628 through the circuit board 626. The hole 628 is sized and shaped to receive a feed line.

Figure 9:
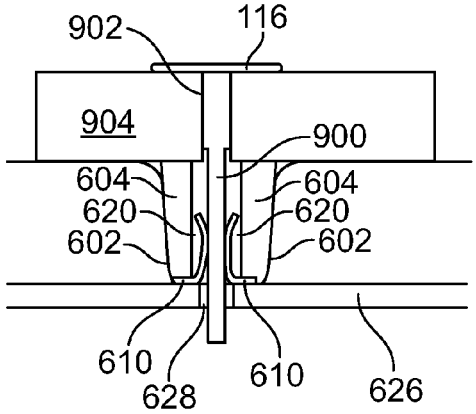
FIG. 9 is a cross section of the structure shown in FIG. 7 taken through section lines 8-8 and showing a feed line inserted into the ferrule and an included clip.

FIG. 9 shows a feed line 900 inserted into the flexible and dielectric ferrule 604, through the connection clip 612 fit inside the ferrule 604 and through the hole 628 formed in the circuit board 626. The feed line 900 is also shown extending upwardly from the shield portion 602, through a hole 902 formed into a dielectric block 904 that supports an patch antenna, not shown in FIG. 9.

The left side 618 and the right side 620 of the clip 612 are comprised of heat treated metal strips or spring-like metal strips having a high elastic modulus. Forming the clip from spring-like metal imbues the clip 612 with the ability to grip the feed line 900, make a good electrical connection thereto and, hold the feed line in place. The clip 612 thus allows the feed line from a patch antenna, and hence the antenna itself, to be "pushed" into the clip 612, inside the ferrule 604, which is inside the shield portion 602 of a stamped metal housing. Stated another way, the housing 600 having such a ferrule and clip act as a connector by which the antenna can be electrically and mechanically attached to a circuit board.

Figure 10:
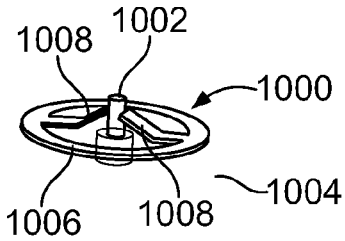
FIG. 10 is a perspective view of a clip to removably attach or connect a feed line to a circuit board.

FIG. 10 is a perspective view of a feed line attachment clip 1000. It is configured to be attached or connected to the portion of a feed line 1002 that extends through a circuit board 1004 simply by sliding the clip 1000 over the portion of a feed line 1002 that extends past a bottom surface 1004 of a circuit board 1004. The feed line attachment clip 1000 shown in FIG. 10, can also be used to clamp a feed line that extends past the feed line connection clip 612 that is placed inside the ferrule 604 and shown in FIG. 9.

The clip 1000 has a substantially circular base portion 1006, which stabilizes the clip 1000 against a circuit board 1004. Two, spring-like wings 1008 that extend inwardly from the base portion 1006 and toward each other are configured to deflect away from each other as shown in the figure, when a shaft-like body is forced between them. In FIG. 10, a portion of a feed line 1002 pushed into the wings 1008 is locked in place by edges or corners at the extreme ends of the two wings 1008.

Figure 11:
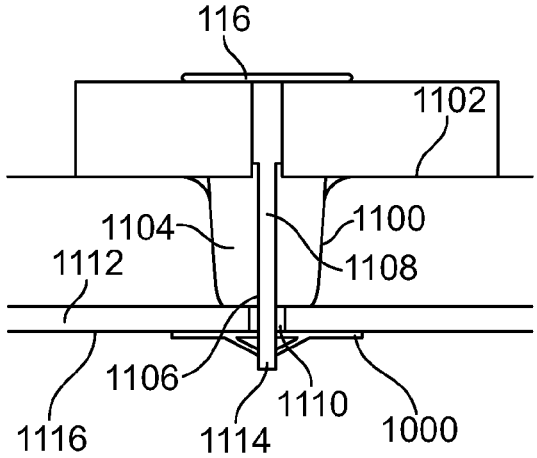
FIG. 11 is a cross section of shield portion having an included ferrule, a feed line extending through the ferrule with the bottom end of the feed line attached to the circuit board using the clip shown in FIG. 10.

FIG. 11 is a cross section of shield portion 1100 of a metallic housing 1102 having an included dielectric ferrule, 1104 with a through hole 1106 that receives an antenna feed line 1108. The feed line 1108 is long enough to protrude through a hole 1110 formed into a circuit board 1112 to which the housing 1102 is attached by solder joints, which are not shown in the figure. The feed line attachment clip 1000 grips the end portion 1114 of the feed line 1108 and locks the feed line in place. A signal-carrying conductive trace provided to the bottom surface 1116 of the circuit board 1112 and located between the clip 1000 and the circuit board 1112 provides a signal path into and out of the antenna with the ferrule 1104 maintaining feed line 1108 alignment and the shield portion 1100 shielding the feed line signals.

Figure 12:
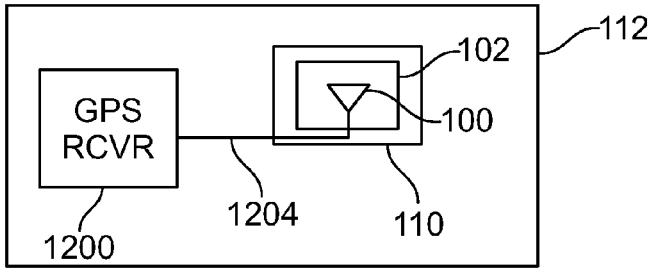
FIG. 12 is a block diagram of a communication device that employs the patch antenna.

FIG. 12 is a schematic diagram of a communication device 1200, which for illustration purposes employs the patch antenna 100, substrate 102 and the housing 110 depicted in FIGS. 1-5. The communication device 1200 is embodied as a conventional GPS receiver 1202 mounted to the aforementioned circuit board 112. The GPS receiver 1200 is electrically connected to the patch antenna 100 by a conductive circuit board trace 1204. The antenna 100 is described above and depicted in the FIGS. 1-5. The shield portions, ferrules and connectors described above are used by the communication device 1200 but those of ordinary skill in the will appreciate that they are not visible in FIG. 12 because of the figure's scale.

The foregoing description is for purposes of illustration only. The true scope of the invention is set forth in the appurtenant claims.

What is claimed is:

1. An antenna comprising:

an electrically conductive component housing, having a top surface, which is attached to a lower surface of a dielectric block having an opposing upper surface, the upper surface of the dielectric block having attached to it a bottom side of a patch antenna having an opposing top side, the electrically conductive component housing top surface providing a ground plane for the patch antenna, the top surface of the component housing being supported by at least one sidewall having a first height, the at least one sidewall surrounding the top surface of the component housing, the component housing additionally having a shield portion (shield), having a cross sectional shape that is substantially trapezoidal, the shield portion extending downwardly from the top surface, the shield portion enclosing an elongated antenna feed line that is connected to and extends from the bottom side of the patch antenna, through a hole in the dielectric block and through the substantially shield portion.

2. The antenna of claim 1, wherein the shield portion is configured to be electrically connected to a reference potential of a circuit board.

3. The antenna of claim 1, further comprising a dielectric ferrule inside the shield portion and configured to align the elongated feed line in the shield portion.

4. The antenna of claim 3, wherein the dielectric ferrule is comprised of a through hole for the feed line, the through hole having a surface at least partially covered with a conductive material configured to make electrical contact with the feed line, the conductive material being capable of being electrically connected to a conductor on a circuit board.

5. The antenna of claim 3, wherein the dielectric ferrule is comprised of a through hole for the feed line and defining a surface through dielectric, the dielectric ferrule being additionally comprised of a resilient connector configured to electrically connect a feed line that extends though the ferrule, to a conductor on a circuit board.

6. The antenna of claim 3, further comprised of a feed line clip, at least a portion of which is located inside the ferrule.

7. The antenna of claim 1, wherein the first height is selected to enable the housing to be attached to a circuit board and enclose at least one component attached to the circuit board.

8. The antenna of claim 1, wherein the shield portion has a second height substantially equal to the first height.

9. The antenna of claim 1, wherein the shield portion has a second height less than the first height.

10. The antenna of claim 1, wherein the housing is configured to be attached to a circuit board and to extend over at least one component attached to the circuit board.

11. The antenna of claim 1, further comprising a feed line clip, configured to be attached to a portion of the feed line that extends through a circuit board.

12. An antenna comprising:

a substantially planar dielectric having first and second opposing surfaces and a first through hole that extends between the first and second opposing surfaces;

a patch antenna layer having top and bottom opposing sides, the bottom side of the patch antenna layer being attached to the first surface of the planar dielectric;

a conductive ground plane having top and bottom opposing sides, the top side of the conductive ground plane being attached to the second surface of the substantially planar dielectric, the conductive ground plane having a feed line opening, which extends between the top and bottom sides of the conductive ground plane, the feed line opening being substantially aligned with the through hole in the substantially planar dielectric;

an elongated feed line having a length and first and second ends, the first end being connected to the first side of the patch antenna, the feed line extending through the through hole in the dielectric and through the feed line opening in the conductive ground plane and, extending away from the conductive ground plane by a first distance; and an electrically conductive component housing having a planar top surface attached to the bottom side of the ground plane, the component housing having at least one sidewall having a height less than the first distance, the housing being stamped and configured to provide an electrically-conductive and electrically grounded shield, which has a cross section shape that is substantially trapezoidal, the shield being aligned with the feed line opening, aligned with the through hole and extending around the feed line.

13. The antenna of claim 12, wherein the feed line is configured to conduct radio frequency energy between a communications device and the patch antenna, and wherein the shield is configured to contain radio frequency energy from the feed line, substantially inside the housing.

14. The antenna of claim 12, wherein the shaped shield has a height substantially equal to the sidewall height.

15. The antenna of claim 12, further comprising a dielectric ferrule inside the shield, surrounding the feed line and centering the feed line in the shield, the dielectric ferrule having a through hole through which the feed line extends, the through hole having a surface, which is at least partially coated with a conductor.

16. A communication device comprising:

a substantially planar dielectric layer having first and second opposing surfaces and a hole that extends through the substantially planar dielectric layer, between the first and second opposing surfaces;

a patch antenna layer attached to the first surface;

a ground plane attached to the second surface and having a feed line opening therein, the feed line opening being substantially aligned with the hole through the substantially planar dielectric layer;

an elongated feed line having a length and first and second ends, the first end being connected to the patch antenna, the feed line extending through the hole that extends through the dielectric layer, through the feed line opening and, extending away from the ground plane by a first distance;

an electrically conductive component housing having an electrically conductive and substantially planar top surface attached to the ground plane, the electrically conductive housing also having at least one sidewall having a height less than the first distance, the housing being configured to provide an electrically conductive and an electrically grounded conduit, having a substantially trapezoidal-shaped cross section around the feed line, which passes through the conduit; and a radio frequency receiver inside the housing and electrically coupled to the second end of the elongated feed line.

17. The communications device of claim 16, wherein the receiver is a GPS receiver.

18. The communications device of claim 16, wherein the conduit is configured to confine radio frequency energy therein.

19. The communications device of claim 16, further comprising a dielectric ferrule inside the conduit and surrounding and aligning the feed line with the conduit, the dielectric ferrule having a hole through which the fee line extends, the hole having a surface at least partially covered by a conductive material in electrical contact with the feed line.

20. The communications device of claim 16, wherein the housing is configured to be attached to a circuit board and to extend over at least one component attached to the circuit board.

* * * * *